US008074466B2

(12) United States Patent
Kim et al.

(10) Patent No.: US 8,074,466 B2
(45) Date of Patent: Dec. 13, 2011

(54) REFRIGERATOR WITH DISPENSER MOUNTED ON THE EXTERIOR OF THE DOOR

(75) Inventors: Seong Jae Kim, Ansan-si (KR); Hyeong Kook Lee, Seongnam-si (KR); Kyung Han Jeong, Seoul (KR)

(73) Assignee: LG Electronics Inc., Seoul (KR)

( * ) Notice: Subject to any disclaimer, the term of this patent is extended or adjusted under 35 U.S.C. 154(b) by 314 days.

(21) Appl. No.: 11/970,539

(22) Filed: Jan. 8, 2008

(65) Prior Publication Data

US 2008/0174219 A1 Jul. 24, 2008

(30) Foreign Application Priority Data

Jan. 18, 2007 (KR) ..... 10-2007-0005520

(51) Int. Cl.
*F25D 3/00* (2006.01)
*F25D 25/00* (2006.01)
*B67D 7/84* (2010.01)

(52) U.S. Cl. ..... 62/389; 222/163; 222/164; 62/377

(58) Field of Classification Search ..... 62/389, 62/440, 289, 377, 340; 222/164.6, 163, 164
See application file for complete search history.

(56) References Cited

U.S. PATENT DOCUMENTS

| | | | | |
|---|---|---|---|---|
| 5,542,265 | A * | 8/1996 | Rutland | 62/389 |
| 7,013,667 | B2 * | 3/2006 | Jung | 62/389 |
| 7,287,555 | B2 * | 10/2007 | Heger et al. | 141/86 |
| 2005/0072178 | A1 * | 4/2005 | Park et al. | 62/389 |
| 2005/0268638 | A1 * | 12/2005 | Voglewede et al. | 62/389 |
| 2006/0201194 | A1 * | 9/2006 | Bowen et al. | 62/344 |

FOREIGN PATENT DOCUMENTS

| | | | |
|---|---|---|---|
| KR | 201985006891 | U | 9/1985 |
| KR | 200122731 | Y1 | 8/1998 |
| KR | 10-1999-0062172 | A | 7/1999 |
| KR | 10-2005-0024699 | A | 3/2005 |
| KR | 10-2006-0085985 | A | 7/2006 |
| KR | 10-2006-0096534 | A | 9/2006 |

* cited by examiner

*Primary Examiner* — Frantz Jules
*Assistant Examiner* — Cassey D Bauer
(74) *Attorney, Agent, or Firm* — Fish & Richardson P.C.

(57) ABSTRACT

There is provided a refrigerator. The refrigerator includes a storage space receiving food, a door, and a dispensing apparatus. The door selectively opens and closes the storage space. The dispensing apparatus dispenses contents stored in the storage space without opening the door. The dispensing apparatus substantially protrudes from an outer surface of the door.

4 Claims, 3 Drawing Sheets

REFRIGERATOR WITH DISPENSER MOUNTED ON THE EXTERIOR OF THE DOOR

BACKGROUND

The present disclosure relates to a refrigerator, and more particularly, to a refrigerator, a door for a refrigerator, and a dispensing apparatus for a refrigerator that enable to obtain contents easily.

A refrigerator is widely used as a cooling apparatus. The refrigerator is divided into a freezing chamber and a chilling chamber. The chilling chamber is maintained at from 3° C. to 4° C. so as to store foods and vegetables for a long time. The freezing chamber is maintained at below zero so as to store meats and foods in frozen state.

Recently, the refrigerator includes various functions for offering convenience to a user, for example, an ice-maker, a water storage tank for cold water, a dispenser, or the like. The ice-maker automatically performs sequential process for ice-making such that a user can obtain ice without particular manipulation. The dispenser allows a user to obtain ice or water outside the refrigerator. The ice-maker making ice in the refrigerator, the water storage tank, and the dispenser properly dispensing ice or cold water to the outside are already well-known, and thus description thereof will not be given.

A related art dispenser includes a receiving space for a container filled with water or ice dispensed from the dispenser. Here, the receiving space is formed in a recessed portion of a door of the refrigerator. Therefore, the dispenser always occupies a certain space even when it is not used, thereby limiting the use of an internal space of the door. Also, since the dispenser occupies the internal space of the door, the door itself becomes thin and a large amount of heat is lost. Additionally, interference occurs between components inside the door, making fabrication of the refrigerator difficult.

In addition, if the dispenser protrudes more from an inner surface of the door, the dispenser occupies an internal space of the refrigerator, thereby reducing the internal space of the refrigerator.

Furthermore, since a container having a volume or a length greater than the receiving space cannot be used for obtaining water or ice from the dispenser, there is a limitation on the size of the container.

SUMMARY

Embodiments provide a refrigerator, a door for a refrigerator, and a dispensing apparatus for a refrigerator capable of increasing an internal space of a refrigerator, obtaining a thickness of a door to reduce a heat loss, preventing interference between components inside a door, and enabling a user to easily obtain contents discharged from a dispensing apparatus regardless of the size and length of a container.

In an embodiment, there is provided a refrigerator, including: a storage space receiving food; a door selectively opening and closing the storage space; and a dispensing apparatus dispensing contents stored in the storage space without opening the door, wherein the dispensing apparatus substantially protrudes from an outer surface of the door.

In another embodiment, there is provided a door for a refrigerator, the door including: an outer surface defining an exterior; a body protruding from the outer surface and providing a space the outer surface the body; and a nozzle and/or a chute received in the space and discharging contents through the outer surface.

In a further environment, there is provided a dispensing apparatus for a refrigerator, the dispensing apparatus including: a dispensing unit protruding from an outer surface of a door of the refrigerator and discharging contents out of the refrigerator; and a body unit covering the discharge unit except a bottom surface of the discharge unit.

According to the present invention, an internal space formed in a recessed portion of a door can be used as an internal space of a refrigerator, and a user can conveniently obtain ice and water regardless of the size and kind of a container. In addition, the thickness of the door can be obtained, reducing a heat loss. Furthermore, since interference between components inside the door can be prevented, the refrigerator can be fabricated more easily.

DETAILED DESCRIPTION OF THE EMBODIMENTS

Reference will now be made in detail to the embodiments of the present disclosure, examples of which are illustrated in the accompanying drawings.

Figure 1:
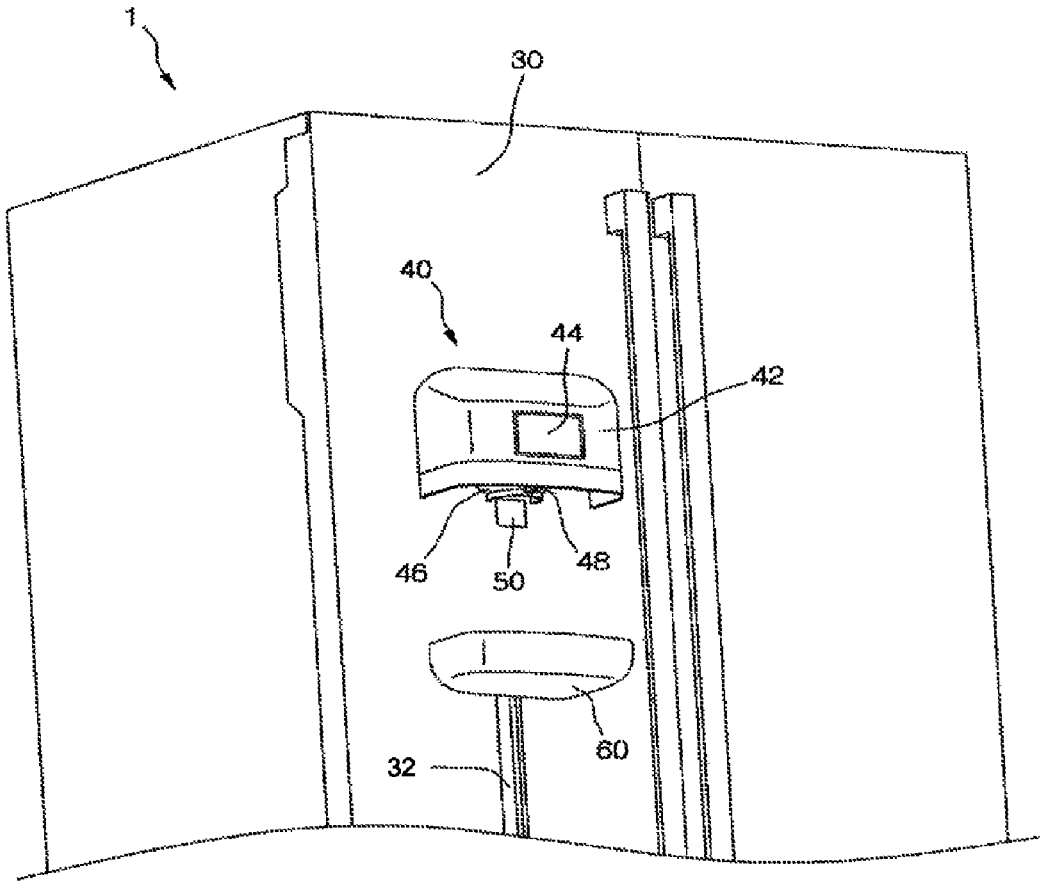
FIG. 1 is a perspective view of a refrigerator according to an embodiment of the present disclosure.

FIG. 1 is a perspective view of a refrigerator.

Referring to FIG. 1, a refrigerator 1 according to embodiments is a side by side type refrigerator with a chilling chamber and a freezing chamber and their doors disposed at right and left sides, respectively. Of course, the freezing chamber and the chilling chamber may be variously configured by a person with ordinary skill in the art. For example, first and second chilling chambers may be disposed at both sides of an upper portion and a freezing chamber may be disposed at a lower portion. Alternatively, a single freezing chamber or a single chilling chamber may be provided in a refrigerator.

A dispensing apparatus 40 for discharging predetermined food such as water or ice is formed on a front surface of a door 30 of the freezing chamber. The dispensing apparatus 40 protrudes from the front surface of the door 30. The dispensing apparatus 40 may be formed on a door of a chilling chamber, not the door 30 of the freezing chamber.

Such a structure can decrease the thickness of the door 30 and enlarge a space of the freezing chamber, compared with when the dispensing apparatus 40 is formed in a concave portion of the door 30. In addition, a receiving space for water or ice is not formed in a concave portion of the door 30. That is, the receiving space is separated from other surfaces of the door 30 and does not form a step area extending from an outer surface of the door 30.

The dispensing apparatus 40 allows a user to obtain water or ice. The dispensing apparatus 40 may include a chute 46 for obtaining ice and a nozzle 48 for obtaining drinks. The chute 46 and the nozzle 48 protrude from an outer surface of the door 30. That is, when the outer surface of the freezing door 30 extends from an edge of a portion where the dispensing apparatus 40 is disposed to form a virtual surface corresponding to the dispensing apparatus 40, the chute 46 and the nozzle 48 are disposed over the virtual surface.

The configuration of the dispensing apparatus 40 will be described in more detail.

A body 42 is provided in the dispensing apparatus 40. The body 42 has a predetermined size and protrudes from the front surface of the door 30. A display unit 44 is disposed on a front surface of the body 42.

The display unit 44 displays operations of the dispensing apparatus 40. The display unit 44 may include a touch screen, or the like so as to control the operation of the dispensing apparatus 40. A manipulation button may be formed around the display unit 44. The display unit 44 may be detached from the dispensing apparatus 40. The display unit 44 may be detachably formed on the body 42 of the dispensing apparatus 40. For example, the display unit 44 may include a magnet or have a linkage structure so as to be attached to and detached from the body 42. Therefore, a user can easily operate the dispensing apparatus 40 without limitation on place. If the display unit 44 controls the operation of the dispensing apparatus 40, the display unit 44 can serve as a remote controller.

The chute 46 for ice and the nozzle 48 for drinks may be disposed under the body 42. Ice made by an ice-making apparatus in the door 30 is guided to the chute 46 along a predetermined guide, and a user can obtain ice outside the door 30 through the chute 46. The nozzle 48 is connected to a water storage tank provided in the refrigerator 1. Therefore, a user can obtain drinks outside the door 30 through the nozzle 48.

Meanwhile, the chute 46 and the nozzle 48 may be arranged in various forms under the body 42. This will be described with reference to FIGS. 2 and 3.

Figure 2:
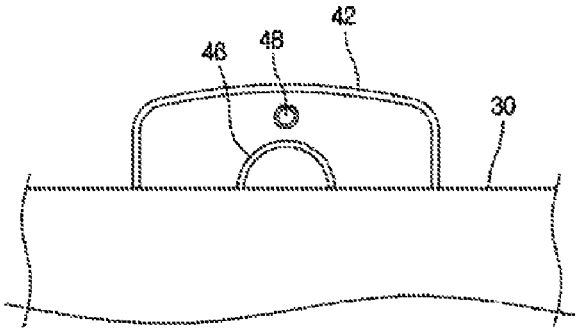
FIGS. 2 and 3 are bottom views for illustrating arrangements of a nozzle and a chute of the dispensing apparatus of FIG. 1.
Figure 3:
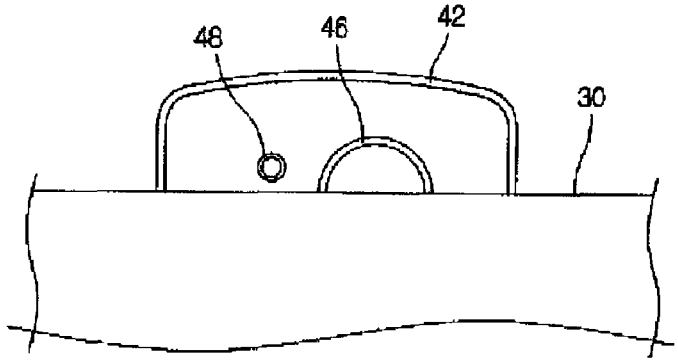

FIGS. 2 and 3 are bottom views for illustrating arrangements of the nozzle 48 and the chute 46 of the dispensing apparatus of FIG. 1.

Referring to FIG. 2, the chute 46 and the nozzle 48 are arranged in series with the door 30 under the body 42. That is, the nozzle 48 and the chute 46 may be sequentially arranged outside the door 30. Alternatively, the chute 46 and the nozzle 48 may be sequentially arranged outside the door 30. In other words, the chute 46 and the nozzle 48 are arranged in forward and backward direction with respect to the front surface of the door 30.

Referring to FIG. 3, the chute 46 and the nozzle 48 are arranged parallel to each other under the body 42. That is, the nozzle 48 and the chute 46 may be arranged parallel to each other outside the door 30. In other words, the nozzle 48 and the chute 46 are arranged in a right and left direction with respect to the front surface of the door 30.

Referring to FIG. 1, again, a button unit 50 is disposed under the chute 46 and the nozzle 48. The button unit 50 controls opening and closing of the chute 46 and the nozzle 48. The button unit 50 may control such that the chute 46 and the nozzle 48 are opened at the same time. For example, the chute 46 and the nozzle 48 may be selectively opened depending on the degree of press of the button unit 50 such that water is discharged by short press and ice is discharged by long press. Alternatively, the button unit 50 may include a chute button and a nozzle button individually provided to respectively open the chute 46 and the nozzle 48. The chute button and the nozzle button selectively open the chute 46 and the nozzle 48, respectively. This configuration may be more useful in the case of the parallel arrangement of the chute 46 and the nozzle 48 in the right and left direction. Furthermore, both ice and water may be discharged by pressing the button unit 50 longer.

The dispensing apparatus 40 may further include a base unit 60. The base unit 60 supports a container for receiving ice and drinks discharged through the chute 46 and the nozzle 48 of the dispensing apparatus 40.

The base unit 60 has a flat upper surface such that the container for receiving ice and drinks is seated thereon. A water collection tray may be disposed on the upper surface of the base unit 60 to receive residual water from the chute 46 and the nozzle 48 of the dispensing apparatus 40.

The base unit 60 may move vertically on the front surface of the door 30 using various configurations such that the height of the base unit 60 can be adjusted depending on the size and length of the container. For example, a guide groove 32 may be formed in the door 30 and a guide protrusion may be formed at one side of the base unit 60, as illustrated in FIG. 1, such that the guide protrusion can be inserted into the guide groove, they may be supported by a frictional force. After the guide protrusion is inserted into the guide groove, they may be supported by a frictional force.

The base unit 60 may be detached from the door 30 such that a user can attach and detach the base unit 60 if necessary.

Figure 4:
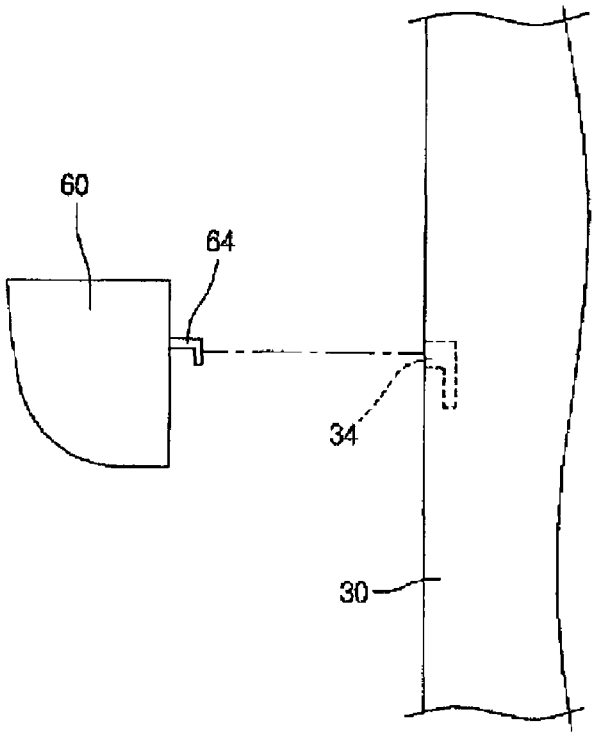
FIG. 4 is a view of a base unit of a dispensing apparatus attached to and detached from a front surface of a door.

FIG. 4 is a view of the base unit 60 of the dispensing apparatus 40 attached to and detached from the front surface of the door 30.

Referring to FIG. 4, a latch groove 34 may be formed in the door 30 and a latching protrusion 64 to be inserted into the latch groove 34 may be formed on the base unit 60. An auxiliary tray 66 may be disposed at one side of the base unit 60 to enlarge an upper surface of the base unit 60. The auxiliary tray 66 enlarges an area of the upper surface of the base unit 60 so as to apply a larger container to the dispensing apparatus 40.

Various configurations may be employed as the auxiliary tray 66 by those skilled in the art.

Figure 5:
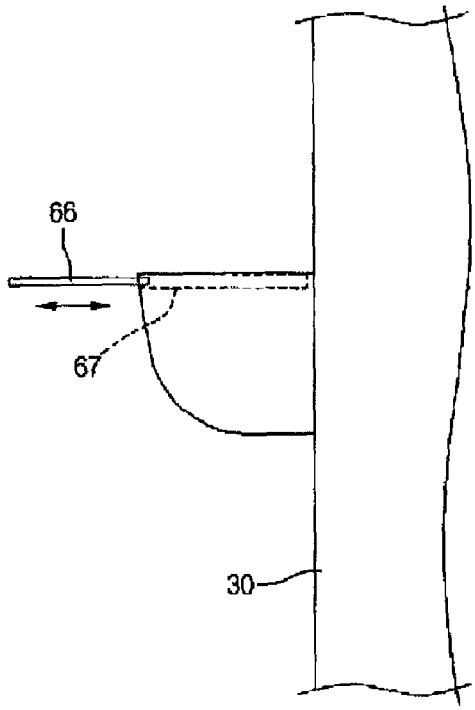
FIGS. 5 and 6 are views of an auxiliary tray according to an embodiment of the present disclosure.
Figure 6:
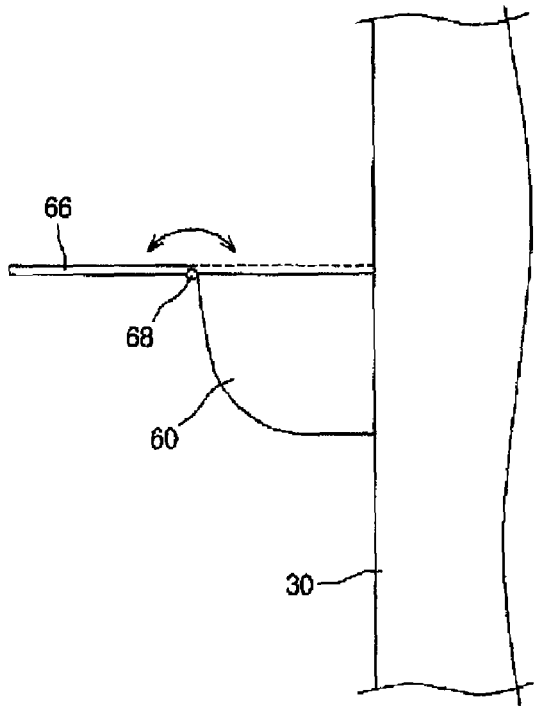

FIGS. 5 and 6 are views of the auxiliary tray 66 according to an embodiment of the present disclosure.

Referring to FIG. 5, a sliding guide 67 may be disposed at one side of the base unit 60, and the auxiliary tray 66 may protrude in a forward direction of the door 30. Here, the upper surface of the base unit 60 may have the same height as an upper surface of the auxiliary tray 66 that slides and protrudes.

Referring to FIG. 6, a hinge 68 may be rotatably disposed between the auxiliary tray 66 and the base unit 60.

Hereinafter, operations of the refrigerator 1 having the dispensing apparatus 40, the door 30 for the refrigerator 1, and the dispensing apparatus 40 for the refrigerator 1 will be described in detail.

A user places the container for receiving water or ice under the body 42 of the dispensing apparatus 40 in order to obtain the water or ice from the dispensing apparatus 40.

When a user pushes the button for operating the chute 46 of the dispensing apparatus 40, an outlet of the chute 46 is opened and ice flows from the ice-making unit into the container. On the other hand, when a user pushes the button for operating the nozzle 48, an outlet of the nozzle 48 is opened and drinks flow from the water container into the container.

When a user pushes the buttons for operating the chute 46 and the nozzle 48 at the same time in order to obtain both ice and water from the dispensing apparatus 40, the outlets of the chute 46 and the nozzle 48 are opened, and ice and water flow into the container at the same time. Of course, the configuration and operation of the button unit 50 may include various modified examples as described above.

Meanwhile, a user may hold the container with hands when water or ice flows into the container from the dispensing apparatus 40, while the base unit 60 of the dispensing apparatus 40 may support the container.

Alternatively, the base unit 60 is detachable from the door 30, and if the container is larger than a space between the body 42 of the dispensing apparatus and the base unit 60, the base unit 60 may be detached and the container may be applied to the dispensing apparatus 40.

Alternatively, the base unit 60 may slide along the guide groove formed in the door 30 to adjust an interval between the body 42 of the dispensing apparatus 40 and the base unit 60. Therefore, if the container is large, the space between the body 42 and the base unit 60 can be enlarged by moving the base unit 60.

The present invention will be apparent to those skilled in the art that various modifications and variations can be made therein without departing from the spirit and scope of the invention.

A dispensing apparatus is added to an inner surface consecutive with other portion of a door and a body is attached to an outer surface of the door and has the same shape as other portions of up and down, and right and left sides. However, the present invention is not limited thereto. For example, even though the outer surface of the door where the body is placed is recessed in an inward direction of the door to a predetermined depth, this is included in the sprit of the present invention provided that the substantial portion of the body protrudes in an outward direction of the door.

In this case, the outer surface of the door corresponding to the body in a forward and backward direction may extend to the base unit in an up and down direction for mounting the container.

In addition, the body including the chute and the nozzle may be separately mounted on the door.

It is intended that the present invention covers the modifications and variations of this invention that come within the scope of the appended claims and their equivalents.

According to the present disclosure, the internal structure of a refrigerator door is simplified, and the refrigerator can be easily fabricated. Also, the internal space of the refrigerator is enlarged and a user can use a container of various sizes and shapes. Furthermore, the door is prevented from becoming thin, reducing a heat loss.

What is claimed is:

1. A refrigerator, comprising:

a storage space configured to receive food;

a door configured to open and close at least a portion of the storage space;

a dispensing apparatus configured to dispense contents stored in the storage space without opening the door, wherein the dispensing apparatus substantially protrudes from an outer surface of the door;

a base unit that is attached to and substantially protrudes from the outer surface of the door, the base unit being configured to support a container being filled by the dispensing apparatus and being configured to move vertically on the outer surface of the door to adjust a distance between the dispensing apparatus and the base unit; and a guide that is configured to guide vertical movement of the base unit, wherein the guide has a vertically extending groove that engages with a portion of the base unit and the base unit is configured to slide along the groove.

2. The refrigerator according to claim 1, wherein the base unit is positioned under the dispensing apparatus and is configured to move in a vertical direction from the dispensing unit.

3. A refrigerator, comprising:

a storage space configured to receive food;

a door configured to open and close at least a portion of the storage space;

a dispensing apparatus configured to dispense contents stored in the storage space without opening the door, wherein the dispensing apparatus substantially protrudes from an outer surface of the door;

a base unit that is attached to and substantially protrudes from the outer surface of the door, the base unit being configured to support a container being filled by the dispensing apparatus and being configured to move vertically on the outer surface of the door to adjust a distance between the dispensing apparatus and the base unit; and a guide that has a groove that engages with a portion of the base unit and the base unit is configured to slide along the groove, the groove located on the outer surface of the door.

4. A refrigerator, comprising:

a storage space configured to receive food;

a door configured to open and close at least a portion of the storage space;

a dispensing apparatus configured to dispense contents stored in the storage space without opening the door, wherein the dispensing apparatus substantially protrudes from an outer surface of the door;

a base unit that is attached to and substantially protrudes from the outer surface of the door, the base unit being configured to support a container being filled by the dispensing apparatus and being configured to move vertically on the outer surface of the door to adjust a distance between the dispensing apparatus and the base unit, wherein the base unit has an auxiliary tray; and a guide that has a groove that engages with a portion of the base unit and the base unit is configured to slide along the groove.

* * * * *